US005776300A

United States Patent [19]

Ogata

[11] Patent Number: 5,776,300

[45] Date of Patent: Jul. 7, 1998

[54] DEVICE OF REGULATING RUNNING POSITION OF UNSEALING TAPE FOR PACKING FILM

[75] Inventor: Taizo Ogata, Chiba-ken, Japan

[73] Assignee: Tokyo Automatic Machinery Works, Ltd. Tokyo, Japan

[21] Appl. No.: 758,524

[22] Filed: Nov. 29, 1996

[30] Foreign Application Priority Data

Dec. 6, 1995 [JP] Japan ..... 7-318173

[51] Int. Cl.[6] ..... B31F 5/00

[52] U.S. Cl. ..... 156/554; 156/555; 156/582; 493/381; 493/382; 493/930

[58] Field of Search ..... 156/554, 555, 156/580, 581, 582, 583.1; 493/377, 381, 382, 930

[56] References Cited

U.S. PATENT DOCUMENTS

| | | | |
|---|---|---|---|
| 3,551,245 | 12/1970 | Gamberini | 156/260 |
| 3,844,872 | 10/1974 | Lenoir et al. | 156/498 |
| 3,933,568 | 1/1976 | Schmermund | 156/512 |
| 4,666,550 | 5/1987 | Spiers et al. | 156/361 |
| 5,203,935 | 4/1993 | May et al. | 156/64 |
| 5,411,625 | 5/1995 | Focke et al. | 156/359 |

FOREIGN PATENT DOCUMENTS

| | | |
|---|---|---|
| 2116747 | 11/1971 | Germany . |
| 3-30246 | 6/1991 | Japan . |

*Primary Examiner*—James Sells
*Attorney, Agent, or Firm*—Greenblum & Bernstein P.L.C.

[57] ABSTRACT

The present invention relates to a device of regulating a running position of unsealing tape for packing film, in which in the normal operation unsealing tape runs on a linear normal running position disposed between projecting portions and by being guided by the projecting portions and while being in contact therewith, if the unsealing tape runs on the outside of an annular groove by being shifted to either side in the width direction, as a result of a relative movement of the annular groove in the direction reverse to the rotational direction of the regulating roller with the rotation of the regulating roller, the unsealing tape gradually enters the annular groove by being guided by corner portions and on the side of openings produced by separating portions and while being in an abrasive contact therewith, thereafter, the unsealing tape is drawn to the normal running position by being guided by approaching portions and while being in contact therewith and finally the unsealing tape is returned to the normal running position by being brought into contact with the projecting portions.

27 Claims, 6 Drawing Sheets

DEVICE OF REGULATING RUNNING POSITION OF UNSEALING TAPE FOR PACKING FILM

TECHNICAL FIELD OF THE INVENTION

The present invention relates to a device of regulating a running position of unsealing tape for packing film in which unsealing tape is laminated onto a predetermined position of packing film and both films are fed to an adhering device to adhere the unsealing tape onto the packing film made of, for example, cellophane or polypropyrene etc. as in wrapping film of cigarette, wrapping film for goods packed in boxes and the like.

More in details, the present invention relates to a device of regulating a running position of unsealing tape for packing film in which unsealing tape fed along a feed path and packing film fed separately from the unsealing tape are laminated together at the midway of the feed path, the laminated body is transferred, the unsealing tape is brought into press-contact with a regulating roller arranged on the feed path thereby regulating the running position of the unsealing tape and the unsealing tape of which position is regulated is adhered onto the packing film by an adhering device.

BACKGROUND ART

There has been a conventional device of regulating a running position of unsealing tape for packing film of this kind having a guide ring for preventing side shift of running unsealing tape by regulating it in the width direction on a feed path upstream from an adhering device as described in, for example, Japanese Examined Utility Model Publication No. Hei 3-30246, column 6, line 44 to column 7, line 2. According to the specific structure of the device an annular groove having the width dimension substantially the same as the width dimension of unsealing tape is recessed in a linear strip shape at the outer peripheral face of the guide ring opposed to and in contact with the running unsealing tape along a normal running position of the unsealing tape without curving in the width direction orthogonal to the running direction. The two side faces of the annular groove are respectively inclined in a tapered shape gradually expanding from the bottom face side of the annular groove toward the opening end thereof. The running unsealing tape is guided to the bottom face side of the annular groove by the two opposed tapered side faces and the unsealing tape runs along the bottom face of the annular groove having the least width dimension without being positionally shifted in the width direction whereby the side shift of the unsealing tape is prevented by regulating the running position of the unsealing tape in respect of the width direction.

However, according to such a conventional device of regulating a running position of unsealing tape for packing film, because of the structure in which the running position of the unsealing tape is regulated in respect of the width direction, the width dimension of the bottom face of the annular groove can be made only slightly larger than the width dimension of the unsealing tape. Furthermore, the width dimension of the opening produced by the tapered side faces can be made only further slightly larger than the width dimension of the bottom face of the annular groove such that even if the unsealing tape floats up from the bottom face of the annular groove along the tapered side faces, the unsealing tape is not positionally shifted significantly in the width direction. Therefore, for example, when the running unsealing tape meanders by slackening or the like whereby the unsealing tape is positionally shifted in the width direction and is about to run off the annular groove, the unsealing tape runs off therefrom simply. Moreover, once the unsealing tape runs off the annular groove, it hardly returns to the inside of the annular groove.

Particularly, when the unsealing tape is significantly shifted in the width direction from the annular groove, the unsealing tape also runs off an adhering device whereby not only the unsealing tape cannot be adhered to packing film or failed products are made but driving of machine must be stopped to prevent the malfunction and as a result, the operational rate is lowered. Hence, it is conceivable to intensify the tension applied on the unsealing tape and make the unsealing tape difficult to run off the annular groove by decreasing the positional shift in respect of the width direction due to slackening thereof.

However, in this case the unsealing tape is extended by the strong tension by which wrinkles are caused in the packing film after the unsealing tape has been adhered thereto, the outlook is deteriorated and the commercial value is considerably reduced.

Furthermore, according to the conventional device the annular groove is narrow and therefore, operation of spanning the unsealing tape is difficult to carry out.

SUMMARY OF THE INVENTION

Accordingly, it is a first object of the present invention to regulate to return unsealing tape that is about to run off an annular groove back to a normal position.

It is a second object of the present invention to facilitate working of an annular groove.

It is a third object of the present invention to stably run unsealing tape at a normal running position.

It is a fourth object of the present invention to promote positioning accuracy of unsealing tape.

It is a fifth object of the present invention to accurately adhere unsealing tape to a predetermined position of packing film.

It is a sixth object of the present invention to regulate a large amount of meandering of unsealing tape successively to smaller amounts thereof.

It is a seventh object of the present invention to regulate the position of unsealing tape at each occurrence of meandering.

It is an eighth object of the present invention to simplify the rotational structure of a regulating roller.

In order to resolve the first object, according to the present invention an annular groove for fitting in running unsealing tape is recessed at the outer peripheral face of a regulating roller in the peripheral direction of the regulating roller and there are continuously formed respectively at two opposed side faces of the annular groove in the peripheral direction, projecting portions mostly projected to a normal running position of the unsealing tape, separating portions gradually separating toward the outside of the unsealing tape in the width direction in respect of the normal running position as the separating portions proceed from the projecting portions in the direction reverse to the rotational direction of the regulating roller and approaching portions gradually approaching toward the inside of the unsealing tape in the width direction in respect of the normal running position as the approaching portions proceed from the most separated portions in the direction reverse to the rotational direction of the regulating roller. According to the above-described structure, in the normal operation the unsealing tape runs at the linear normal running position disposed between the projecting portions by being guided by the projecting portions while being in contact therewith. Even if the unsealing tape runs on the outside of the annular groove by being shifted to either side in the width direction, as a result of a relative movement of the annular groove in the direction reverse to the rotational direction of the regulating roller with the rotation of the regulating roller, the unsealing tape gradually enters the annular groove by being guided by corners of the openings at the separating portions while being in an abrasive contact therewith, thereafter, the unsealing tape is drawn to the normal running position by being guided by the approaching portions while being in contact therewith and the unsealing tape is finally returned to the normal running position by being in contact with the projecting portions. In this way the unsealing tape that is about to run off the annular groove can be regulated to return to the normal position.

Therefore, compared with the conventional device in which the width dimension of the bottom face of the annular groove can be made only slightly larger than the width dimension of unsealing tape and further. The width dimension of the opening produced by the tapered side faces can be made further more slightly than the width dimension of the bottom face of the annular groove, a wide range of meandering can be regulated, failed products are not made by the unsealing tape which runs off an adhering device whereby the operational rate is promoted since it is not necessary to stop driving of machine, compared with the conventional device in which the tension applied on the unsealing tape is intensified and the unsealing tape is made difficult to run off the annular groove, wrinkles are not caused on the packing film after adhering the unsealing tape thereon, the outlook is improved and the commercial value is promoted. Also, compared with the conventional annular groove in a linear strip shape, the annular groove is widened in the width direction of the unsealing tape by width amounts of the separating portions, portions mostly separated from the normal running position and the approaching portions and therefore, operation of spanning the unsealing tape is facilitated and the operational performance is promoted.

In order to resolve the second object, according to the present invention the annular groove has the structure in which it is alternately curved in the width direction orthogonal to the running direction centering on the normal running position of the unsealing tape.

By the above-described structure the annular groove is provided with the same width over the entire length in the peripheral direction. Thereby, working of the annular groove is facilitated and the cost reduction is achieved.

In order to resolve the third object, according to the present invention the unsealing tape is wound around the outer peripheral face of the regulating roller such that the unsealing tape passes through at least either one of the regions in each of which the projecting portion is formed and a timing where the unsealing tape simultaneously passes through both of these regions, is provided.

According to the above-described constitution the unsealing tape is guided by simultaneously being brought in contact with the both projecting portions formed respectively on the side faces of the annular groove and accurately positioned to the normal running position. Thereby, the unsealing tape is made to run stably at the normal running position.

In order to resolve the fourth object, according to the present invention a plurality of sets of the continuous peripheral arrangement of the projecting portions, the separating portions, the portions mostly separated from the normal running position and the approaching portions are provided respectively on the both side faces of the annular groove.

According to the above-described structure the possibility whereby the unsealing tape simultaneously passes between the plurality of the projecting portions is promoted and the angles of inclination at the separating portions and the approaching portions can be set to angles suitable for guiding the unsealing tape. Thereby, the accuracy of regulating to position the unsealing tape can be promoted.

In order to resolve the fifth object, according to the present invention the regulating roller is arranged upstream from and adjacent to the adhering device and the interval between the projecting portions formed at the two side faces of the annular groove of the regulating roller is made to be substantially the same as the width dimension of the unsealing tape.

According to the above-described constitution the position of the unsealing tape is regulated without being shifted in the width direction by the projecting portions of the annular groove immediately before being transferred to the adhering device. Thereby, the unsealing tape can be adhered onto a predetermined position of the packing film.

In order to resolve the sixth object, according to the present invention a plurality of regulating rollers are installed on a feed path, the interval between the projecting portions of a regulating roller at the most downstream side is made to be substantially the same as the width dimension of the unsealing tape and the intervals of the projecting portions of regulating rollers arranged upstream therefrom are gradually widened toward the upstream side such that the more upstream the regulating rollers are disposed the wider the intervals.

According to the above-described constitution the position of the unsealing tape is loosely regulated in the width direction by passing through the regulating rollers on the upstream side and thereafter, the regulating width in respect of the movement in the width direction is gradually narrowed at each time of successively passing the regulating rollers on the downstream side. Thereby, a large amount of meandering of the unsealing tape can be regulated successively to smaller amounts of meandering.

In order to resolve the seventh object, according to the present invention a plurality of regulating rollers are installed on a feed path and the intervals between the projecting portions of all the regulating rollers are made to be substantially equal to the width dimension of unsealing tape.

According to the above-described constitution the position of the unsealing tape is regulated in the width direction by the respective projecting portions of the annular groove at each occasion of passing through each one of the plurality of regulating rollers. Thereby, the position of the unsealing tape can be regulated at each occurrence of meandering.

In order to resolve the eighth object, according to the present invention running packing film is brought into press-contact with the outer peripheral face of the regulating roller and the regulating roller is rotated by friction caused in running the packing film.

According to the above-described constitution a drive source for rotating the regulating roller is not necessary. Thereby, the rotational structure of the regulating roller can be simplified.

DESCRIPTION OF THE PREFERRED EMBODIMENTS

An explanation will be given of embodiments of the present invention based on the drawings as follows.

Figure 1:
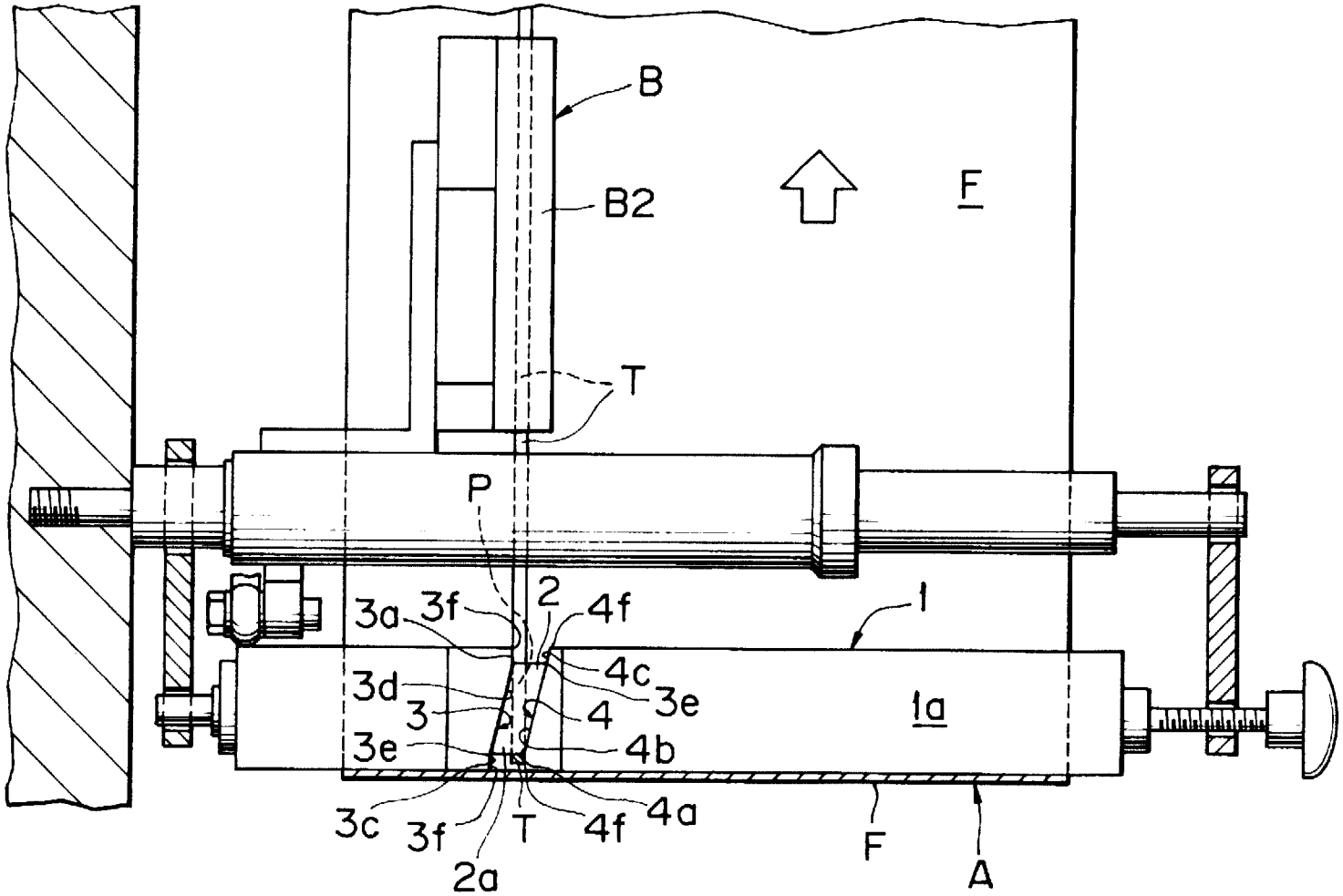
FIG. 1 is a partially-cut longitudinal front view of a device of regulating a running position of unsealing tape for packing film showing an embodiment of the present invention.
Figure 2:
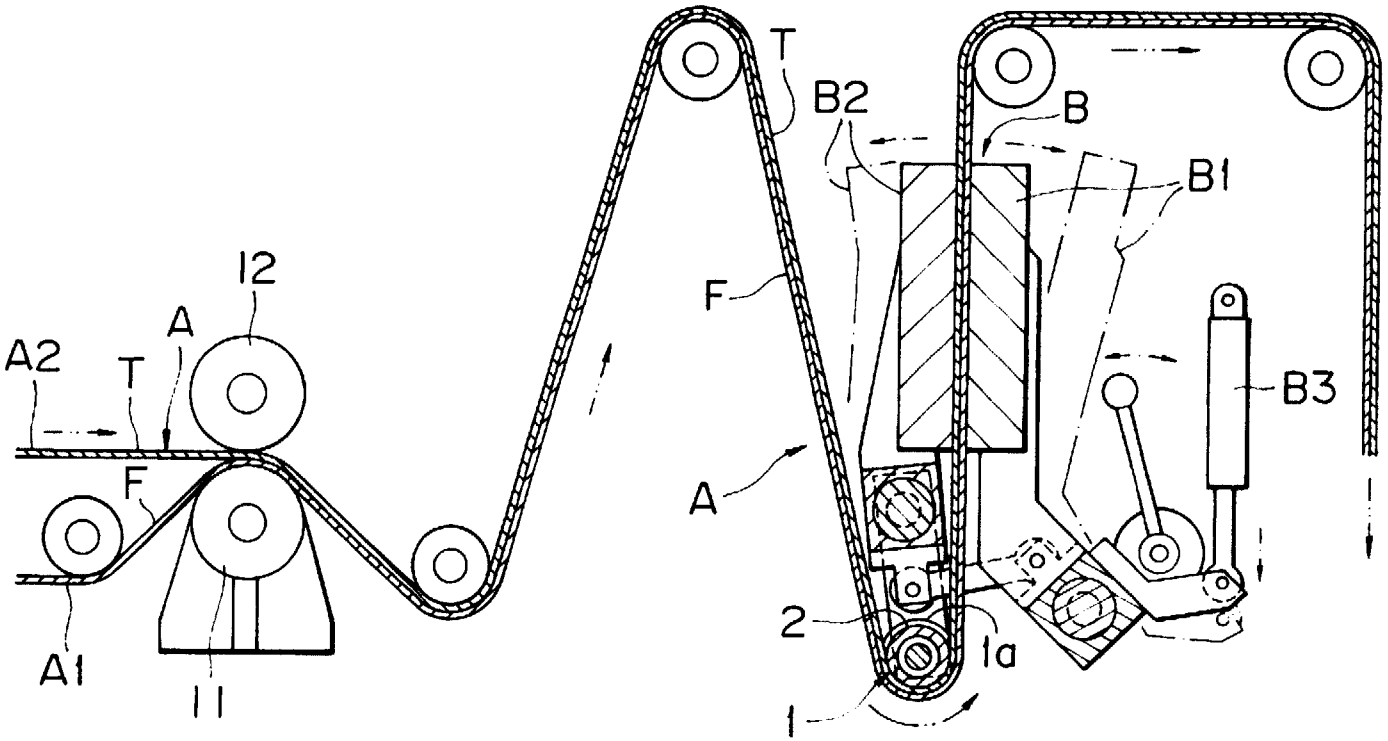
FIG. 2 is a reduced longitudinal side sectional view thereof.

As illustrated in FIG. 1 and FIG. 2, according to an embodiment of the present invention unsealing tape T fed along a feed path A and packing film F fed along another film feed path A1 are laminated together by pinching them by a feed roller 11 and a press-contact roller 12 and are transferred toward an adhering device B. A regulating roller 1 is rotatably arranged on the feed path A downstream from the feed roller 11 and the press-contact roller 12 and in the proximity of an adhering device B and upstream from the adhering device B. The packing film F and the unsealing tape T are wound in a U-like shape in respect of the side view around an outer peripheral face la of the regulating roller 1 over substantially a half of the periphery in the peripheral direction. An annular groove 2 for fitting in the running unsealing tape T is recessed on the outer peripheral face la in the peripheral direction, the running packing film F is brought into press-contact with the outer peripheral face 1*a* except a portion thereof replaced by the annular groove 2 and the regulating roller 1 is rotated by friction caused in running the packing film F.

There are continuously formed in the peripheral direction respectively at two opposed side faces 3 and 4 of the annular groove 2, projecting portions 3*a* and 4*a* mostly projected to a normal running position P on which the unsealing tape T passes when the unsealing tape T is transferred along the feed path A without meandering, separating portions 3*b* and 4*b* gradually separating to the outside of the unsealing tape T in the width direction in respect of the normal running position P as the separating portions proceed from the projecting portions 3*a* and 4*a* in the direction reverse to the rotational direction of the regulating roller 1 and approaching portions 3*d* and 4*d* gradually approaching to the inside of the unsealing tape T in the width direction in respect of the normal running position P as the approaching portions proceed from portions 3*c* and 4*c* mostly separated from the normal running position P in the direction reverse to the rotational direction of the regulating roller 1.

Figure 3:
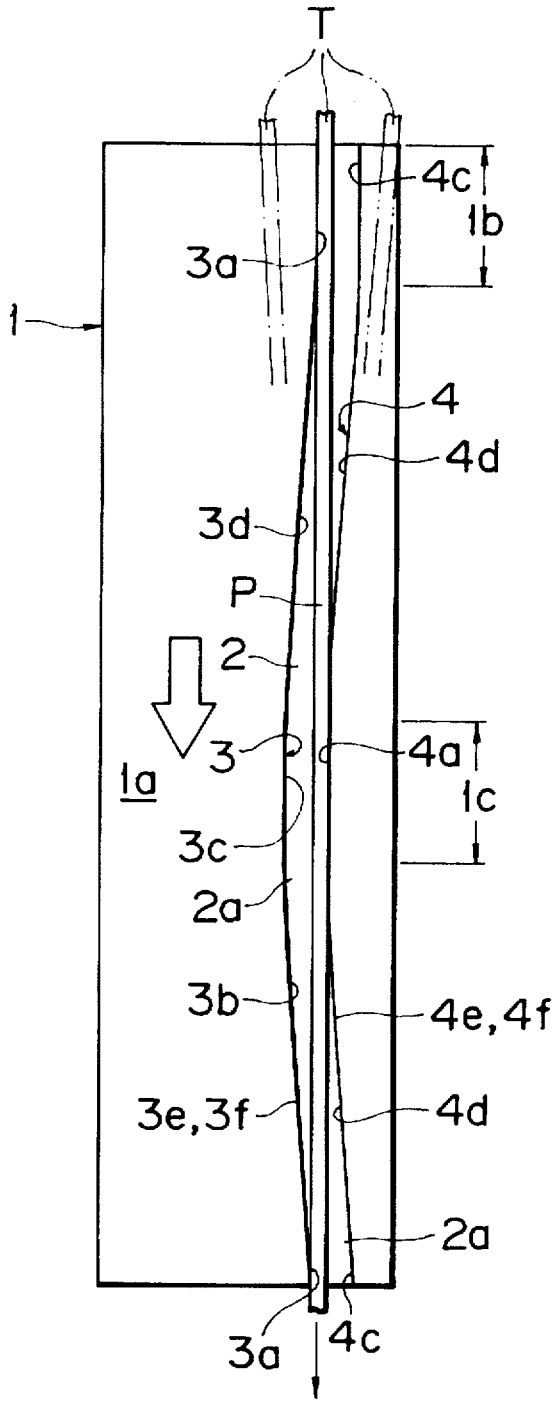
FIG. 3 is an enlarged developed view of the outer peripheral face of a regulating roller.

As illustrated in the developed view of FIG. 3, the annular groove 2 of this embodiment is formed to have the same width dimension over the entire length in the peripheral direction of the regulating roller 1 and the annular groove 2 is alternately curved in the width direction orthogonal to the running direction of the unsealing tape T centering on the normal running position P whereby the projecting portions 3*a* and 4*a* are respectively opposed to the mostly separated portions 4*c* and 3*c* in respect of the width direction, the separating portions 3*b* and 4*b* are respectively opposed to the approaching portions 4*d* and 3*d* in respect of the width direction and respective sets of the projecting portions 3*a* and 4*a*, the separating portions 3*b* and 4*b*, the most separated portions 3*c* and 4*c* and the approaching portions 3*d* and 4*d* are arranged at the two side faces 3 and 4 in continuous curves.

The interval between the projecting portions 3*a* and 4*a* is made to be substantially equal to the width dimension of the unsealing tape T and regions 1*b* and 1*c* where the projecting portions 3*a* and 4*a* are respectively formed, are diametrically opposedly arranged on the outer peripheral face la by an angular difference of 180°. Accordingly, the unsealing tape T wound in a U-like shape in respect of the view over a substantially half of the periphery in the peripheral direction of the outer peripheral face 1*a* of the regulating roller 1, necessarily passes through either one of the regions 1*b* and 1*c* where the projecting portions 3*a* and 4*a* are formed, irrespective of the rotational angular position of the regulating roller 1 and simultaneously passes through the both regions when the regions 1*b* and 1*c* are disposed on a substantially horizontal line.

A bottom face 2*a* of the annular groove 2 is arranged deeper than the thickness dimension of the unsealing tape T and the two side face 3 and 4 are erected substantially vertically toward the opening end of the annular groove 2 whereby corner portions 3*e* and 4*e* on the bottom side are formed substantially in the right angle and corner portions 3*f* and 4*f* on the side of the opening are rounded by rounding them over the entire peripheries.

The regulating roller 1 is formed in a hollow shape and a portion of the outer peripheral face 1*a* where the annular groove 2 is recessed and other portion thereof with which the packing film F is brought into press-contact, are formed by separate members by which working of the annular groove 2 is facilitated and only the portion where the annular groove 2 is recessed is made interchangeable in accordance with size change of the unsealing tape T, or the like. However, the both portions may be integrally formed.

When the adhering position of the unsealing tape T in respect of the packing film F is changed, the arrangement of the portion where the annular groove 2 is recessed is changed or the regulating roller 1 is adjusted to move in the width direction whereby the running position of the unsealing tape T is changed.

The adhering device B is constituted by a conventionally well-known structure illustrated by FIG. 1 and FIG. 2 in which a heater B1 and a heater receiver B2 are openablly and closably arranged to put the feed path A therebetween. When the packing film F and the unsealing tape T are transferred from the feed roller 11 and the press-contact roller 12, by closing the heater B1 and the heater receiver B2 by a drive unit B3 such as an air cylinder or the like as illustrated by bold lines in FIG. 2, the packing film F and the unsealing tape T are squeezed and the both are thermally bonded. When the transfer of the packing film F and the unsealing tape T is stopped, the heater B1 and the heater receiver B2 are opened as illustrated by one-dotted chain lines of FIG. 2 whereby the heater B1 and the heater receiver B2 are released from the packing film A and the unsealing tape T.

Incidentally, the adherence of the packing film F and the unsealing tape T is not limited to the thermal bonding and they may be pasted together by previously coating an adhesive thereon.

Next, an explanation will be given of the operation of the device of regulating a running position of unsealing tape for packing film.

Firstly, in the normal operation in which the unsealing tape T is transferred along the feed path A from the upstream side without meandering and enters the annular groove 2, the unsealing tape T is brought into contact respectively with the projecting portions 3*a* and 4*a* of the two side faces 3 and 4 as shown by bold lines in FIG. 2 and FIG. 3 by which the unsealing tape T is guided and runs passing through the linear normal running position P disposed between the projecting portions 3*a* and 4*a*.

At this occasion the unsealing tape T necessarily passes through either one of the regions 1*b* and 1*c* where the projecting portions 3*a* and 4*a* are formed, irrespective of the rotational angular position of the regulating roller 1 and therefore, the unsealing tape T continues being in contact with either one of the projecting portions 3*a* and 4*a* and when these regions 1*b* and 1*c* are disposed on a substantially horizontal line, the unsealing tape T passes simultaneously both of the regions 1*b* and 1*c* and therefore, the unsealing tape T is accurately positioned to the normal running position P by being brought into contact with both of the projecting portions 3*a* and 4*a* whereby the unsealing tape T stably runs at the normal running position P.

When the running unsealing tape T meanders by slackening or the like and transferred onto the outer peripheral face 1*a* of the regulating roller 1 by being shifted from the upstream side to either side in the width direction in accordance with the meandering, the unsealing tape T runs from the annular groove 2 onto the outer peripheral face, for example, in the left direction of front view as illustrated by one-dotted chain lines in FIG. 3 or runs thereon in the right direction of front view as illustrated by two-dotted chain lines in FIG. 3, or the unsealing tape T is moved to either of the left side and the right side in the annular groove 2.

When the unsealing tape T runs on the outer peripheral face in the left direction, as a result of a relative movement of the annular groove 2 in the direction reverse to the rotational direction of the regulating roller 1 with the rotation of the regulating roller 1, the unsealing tape T gradually enters the annular groove 2 by being guided along the corner portion 3*f* of the opening on the side of the separating portion 3*b* gradually separating from the normal running position P while being kept in abrasive contact therewith and thereafter, the unsealing tape T is drawn to the normal running position P by being guided in the right direction while being in contact with the approaching portion 3*d* that is gradually approaching the normal running position P and finally, the unsealing tape T is returned to the normal running position P by being brought into contact with the projecting portion 3*a*.

When the unsealing tape T runs on the outer peripheral face in the right direction, as a result of a relative movement of the annular groove 2 in the direction reverse to the rotational direction of the regulating roller 1 with the rotation of the regulating roller 1, the unsealing tape T gradually enters the annular groove 2 by being guided by the corner portion 4*f* of the opening of the separating portion 4*b* gradually separating from the normal running position P while being kept in abrasive contact therewith and thereafter, the unsealing tape T is drawn to the normal running position P by being guided in the left direction while being in contact with the approaching portion 4*d* gradually approaching the normal running position P and finally, the unsealing tape T is returned to the normal running position P by being brought into contact with the projecting portion 4*a*.

Therefore, even if the unsealing tape T meanders in the width direction in a wide range, it can be regulated. Even when the unsealing tape T runs on the outside of the annular groove 2 from the inside thereof in starting to transfer the packing film F and the un sealing tape T, the unsealing tape T is returned to the normal running position P by the above-described operation and runs on the normal running position P.

Figure 4:
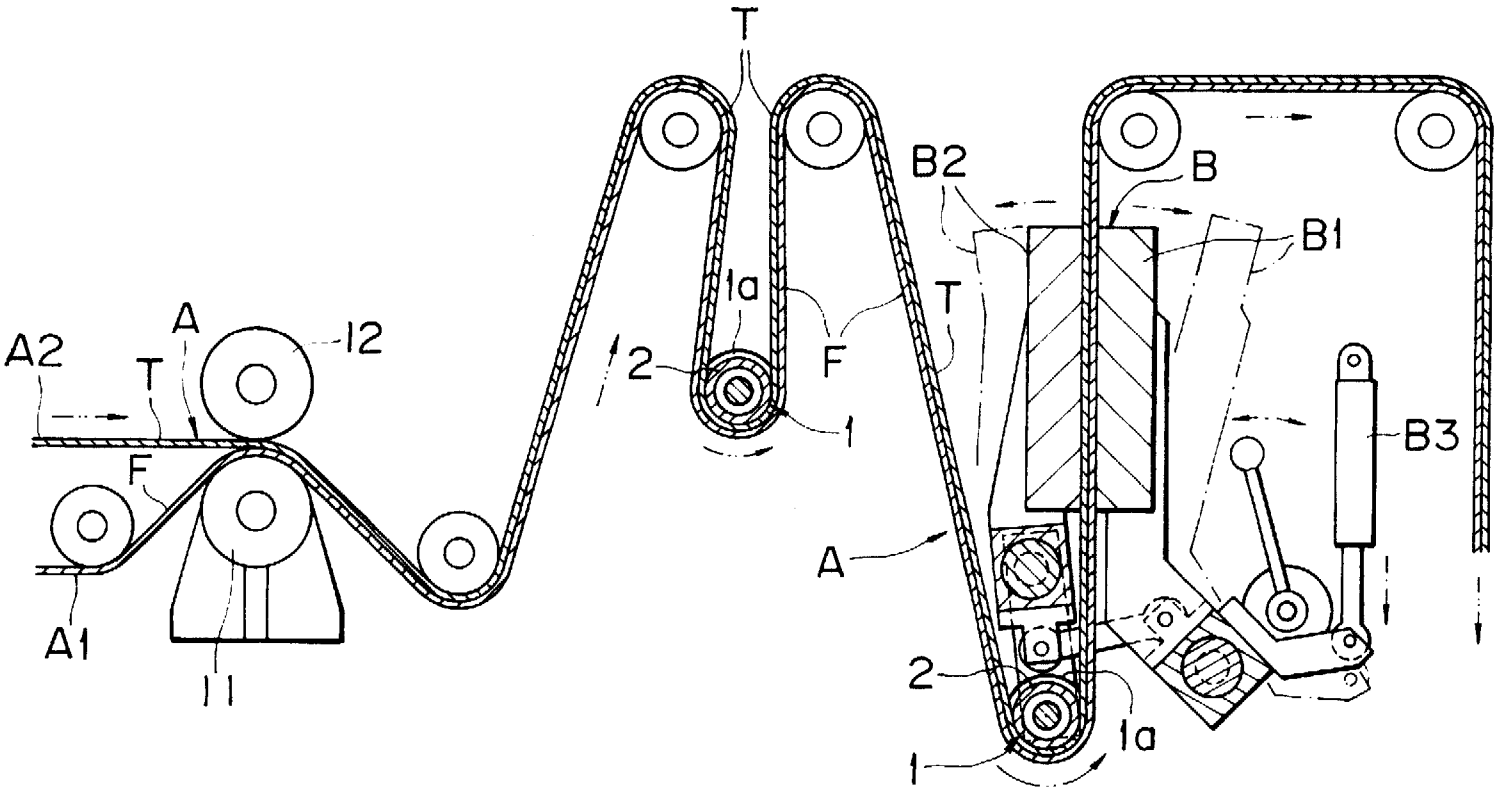
FIG. 4 is a longitudinal side sectional view of a device of regulating a running position of unsealing tape for packing film showing another embodiment of the present invention.

FIG. 4 illustrates another embodiment of the present invention. The difference between this embodiment and the embodiment illustrated in FIGS. 1 and 2 resides in that a plurality of regulating rollers 1 are rotatably arranged on the feed path A downstream from the feed roller 11 and the press-contact roller 12 and one of the regulating rollers 1 on the most downstream side is arranged upstream from and in the proximity of the adhering device B and the other structure stays the same as that in the embodiment illustrated by FIGS. 1 and 2.

Although in the illustrated example two of the regulating rollers 1 are respectively arranged to keep in press-contact with the unsealing tape T, three or more of the regulating rollers 1 may be arranged to keep in press-contact with the unsealing tape T.

Therefore, according to the embodiment illustrated by FIG. 4 the unsealing tape T is regulated to the normal running position P by passing through more annular grooves 2 than that in the embodiment illustrated by FIGS. 1 and 2 by an increase in the number of the regulating rollers 1 and therefore, the unsealing tape stably runs through the normal running position P.

Further, if the annular groove 2 recessed at the regulating roller 1 on the upstream side is curved in the width direction more than the annular groove 2 recessed at the regulating roller 1 on the most downstream side, a wider range of meandering can be regulated.

Furthermore, the interval between the projecting portions 3*a* and 4*a* of the regulating roller 1 on the most downstream side may be made to be substantially equal to the width dimension of the unsealing tape T and the intervals between the projecting portions 3*a* and 4*a* of the regulating rollers 1 arranged upstream therefrom may be gradually widened toward the regulating rollers 1 arranged upstream side such that the more upstream the rollers 1 are arranged the wider the intervals.

Accordingly, in this case the unsealing tape T is loosely positioned in the width direction by passing through the regulating rollers 1 on the upstream side and thereafter, the regulating width in the width direction is gradually narrowed at each time of successively passing the regulating rollers 1 on the downstream side and therefore, a large amount of the meandering of the unsealing tape T can be regulated successively to smaller amounts of meandering.

All of the intervals between the projecting portions 3*a* and 4*a* of the regulating roller 1 from the upstream side to the most downstream side may be substantially equal to the width dimension of the unsealing tape T. Accordingly, in this case the position of the unsealing tape T is regulated by the projecting portions 3*a* and 4*a* of the respective annular grooves at each time of passing the plurality of regulating rollers 1 and therefore, the position of the unsealing tape T can be regulated at each occurrence of meandering.

Figure 5:
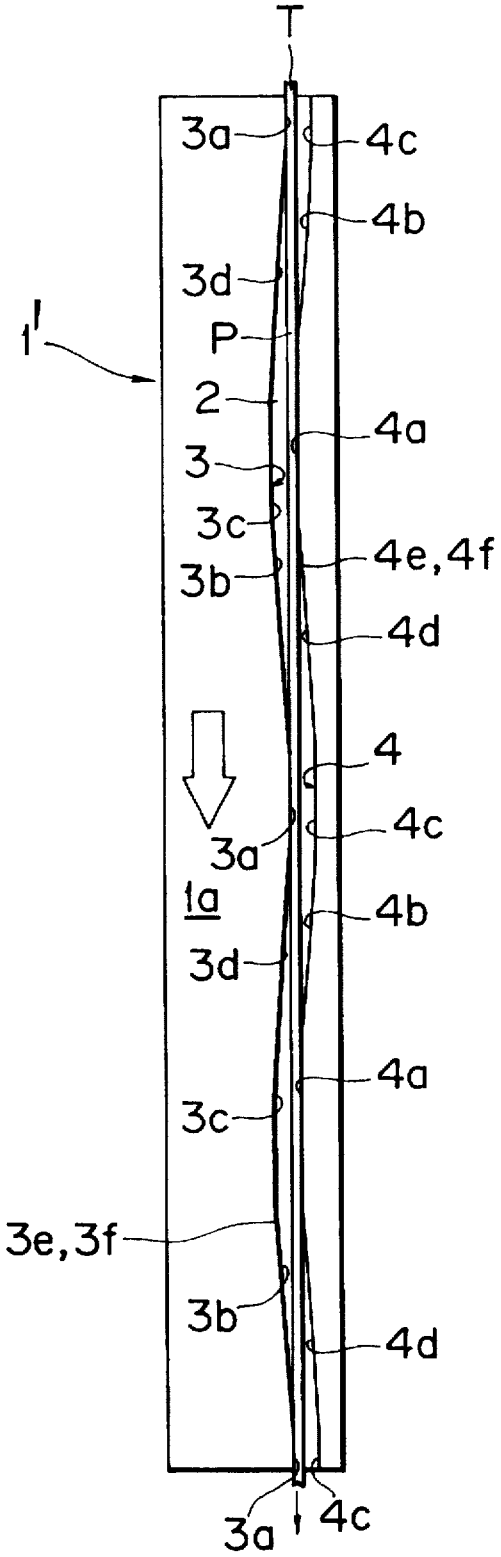
FIG. 5 is a developed view showing a modified example of an annular groove.
Figure 6:
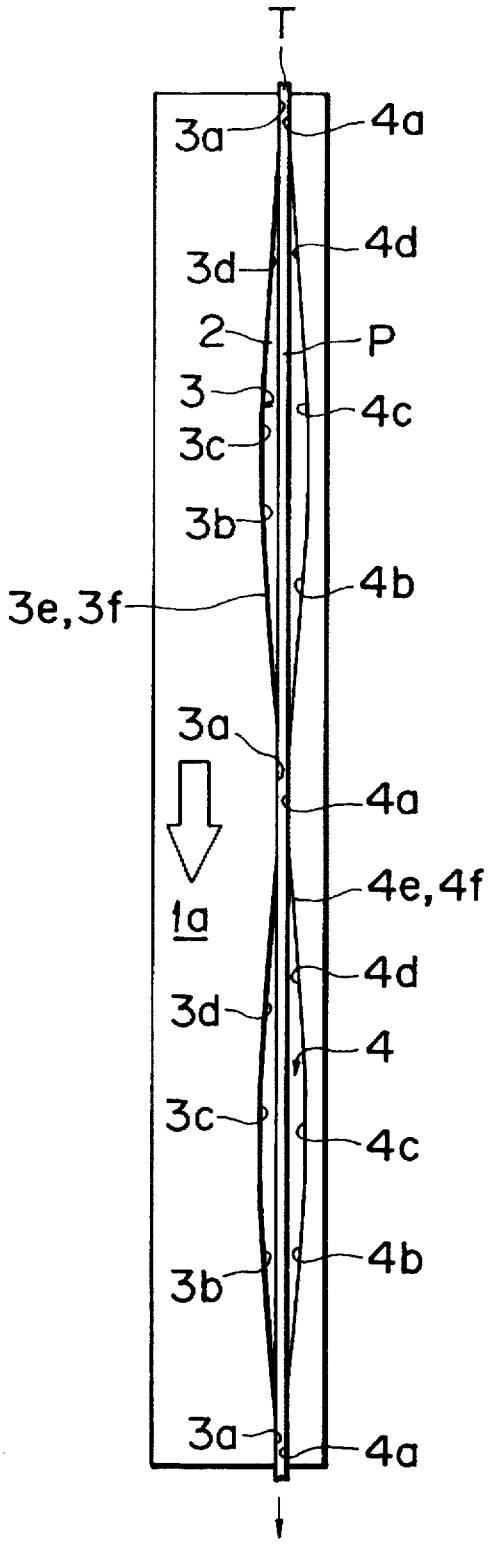
FIG. 6 is a developed view showing another modified example of an annular groove.

FIG. 5 and FIG. 6 are developed views respectively showing modified examples of annular grooves 2.

According to a regulating roller 1' illustrated by FIG. 5, in the case where the outer diameter and the peripheral dimension of a regulating roller 1 are longer than those of the regulating roller 1 shown by FIG. 3, respective pluralities of sets of projecting portions 3*a* and 4*a*, separating portion 3*b* and 4*b*, portions 3*c* and 4*c* mostly separated from the normal running position P and approaching portions 3*d* and 4*d*, are continuously arranged in the peripheral direction on two side faces 3 and 4 of an annular groove 2, which is different from the embodiment shown by FIG. 3.

In this illustrated example by curving the annular groove 2 alternately in the width direction by a plural number of times centering on the normal running position P the respective two sets of the projecting portions 3*a* and 4*a*, the separating portions 3*b* and 4*b*, the portions 3*c* and 4*c* mostly separated from the normal running position P and the approaching portions 3*d* and 4*d*, are arranged. However, three or more of the sets may be arranged.

Accordingly, the possibility whereby the unsealing tape T passes simultaneously between the plurality of projecting portions 3*a* and 4*a* is promoted and angles of inclination of the separating portions 3*b* and 4*b* and the approaching portions 3*d* and 4*d* can be set to angles suitable for guiding the unsealing tape and accordingly, the accuracy of regulating the position of the unsealing tape T can be promoted.

According to an annular groove 2 illustrated in FIG. 6, the annular groove 2 is not curved alternately in the width direction as illustrated by FIG. 3 but projecting portions 3*a* and 4*a*, separating portions 3*b* and 4*b*, portions 3*c* and 4*c* mostly separated from the normal running position P and approaching portions 3*d* and 4*d*, are respectively opposed in the width direction centering on the normal running position P of the unsealing tape T, which is different from the embodiment shown by FIG. 3.

According to the illustrated example the respective plurality of sets of the projecting portions 3*a* and 4*a*, the separating portions 3*b* and 4*b*, the portions 3*c* and 4*c* mostly separated from the normal running position P and the approaching portions 3*d* and 4*d*, are continuously arranged in the peripheral direction and the peripheral dimensions of the most separated portions 3*c* and 4*c* are short. However, the peripheral dimensions of the most separated portions 3*c* and 4*c* may be prolonged by extending the mostly separated portions 3*c* and 4*c* in a linear form in parallel to the peripheral direction.

Incidentally, according to the above-described embodiments a single or a plurality of the regulating rollers 1 are arranged on the feed path A downstream from the feed roller 11 and the press-contact roller 12. However, the present invention is not limited thereto but a single or a plurality of the operating rollers 1 may be arranged on a feed path A2 upstream from the feed roller 11 and the press-contact roller 12 and the position of the unsealing tape T that is being fed on the feed path A2 on the upstream side may be regulated whereby when the unsealing tape is connected in a device of interchanging unsealing tape as described, for example, in Japanese Examined Utility Model Publication No. Hei 3-30246, the unsealing tape may be connected with no positional shift in the width direction.

Furthermore, although the two side faces 3 and 4 of the annular groove 2 are erected substantially vertically and the corner portions on the side of the opening are rounded, the present invention is not limited thereto. The two side faces of the annular groove may be inclined respectively in a tapered shape gradually expanding from the bottom face side of the annular groove toward the opening end. Furthermore, although the running packing film F is brought into press-contact with the outer peripheral face 1*a* of the regulating roller 1 and the regulating roller 1 is rotated by friction caused in running the packing film F, the present invention is not limited thereto but a drive source such as a motor etc. may be connected to the regulating roller 1 and the regulating roller 1 may be driven to rotate in the direction of transferring the packing film F and the unsealing tape T.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope and spirit of the invention as defined by the appended claims.

I claim:

1. A device for regulating a running position of unsealing tape for packing film, in which unsealing tape is fed along a feed path, and a packing film is fed separately from the unsealing tape, said packing film and said unsealing tape are laminated together at an intermediate point of the feed path, the unsealing tape being brought into press-contact with a regulating roller arranged on the feed path which regulates a running path of the unsealing tape, and an adhering device which adheres the unsealing tape onto the packing film, said device comprising:

an annular groove recessed in an outer peripheral face of the regulating roller in a circumferential direction, said annual groove receiving the running unsealing tape;

projecting portions formed at two opposed side faces of the annular groove substantially extending along the running path of the unsealing tape;

separating portions, extending from the projecting portions in the circumferential direction, and gradually extending away from the unsealing tape in a width direction perpendicular to the running path;

intermediate portions, extending from the separating portions substantially along and spaced from the running path of the unsealing tape; and approaching portions, extending from the intermediate portions, along the circumferential direction and gradually tapering toward the running path.

2. The device for regulating a running position of unsealing tape for packing film according to claim 1, wherein the annular groove is alternately curved in the width direction orthogonal to the running path of the unsealing tape.

3. The device for regulating a running position of unsealing tape for packing film according to claim 1, wherein the annular groove is arranged such that the projecting portions, the separating portions, the intermediate portions and the approaching portions are opposedly arranged in the width direction of the unsealing tape centered about the running path of the unsealing tape.

4. The device for regulating a running position of unsealing tape for packing film according to claim 1, wherein the unsealing tape is wound around the outer circumferential surface of the regulating roller such that the unsealing tape passes adjacent to at least one of the projecting portions, and wherein, over a portion of the range in which the regulating roller rotates, the unsealing tape is simultaneously adjacent both projecting portions.

5. The device for regulating a running position of unsealing tape for packing film according to claim 2, wherein the unsealing tape is wound around the outer circumferential surface of the regulating roller such that the unsealing tape passes adjacent to at least one of the projecting portions, and wherein, over a portion of the range in which the regulating roller rotates, the unsealing tape is simultaneously adjacent both projecting portions.

6. The device for regulating a running position of unsealing tape for packing film according to claim 3, wherein the unsealing tape is wound around the outer circumferential surface of the regulating roller such that the unsealing tape passes adjacent to at least one of the projecting portions, and wherein, over a portion of the range in which the regulating roller rotates, the unsealing tape is simultaneously adjacent both projecting portions.

7. The device for regulating a running position of unsealing tape for packing film according to claim 1, wherein the sets of the projecting portions, the separating portions, the intermediate portions and the approaching portions are continuously arranged in the circumferential direction at the two side faces of the annular groove.

8. The device for regulating a running position of unsealing tape for packing film according to claim 2, wherein the sets of the projecting portions, the separating portions, the intermediate portions and the approaching portions are continuously arranged in the circumferential direction at the two side faces of the annular groove.

9. The device for regulating a running position of unsealing tape for packing film according to claim 3, wherein the pluralities sets of the projecting portions, the separating portions, the intermediate portions and the approaching portions are continuously arranged in the circumferential direction at the two side faces of the annular groove.

10. The device for regulating a running position of unsealing tape for packing film according to claim 1, wherein the regulating roller is arranged upstream from the adhering device and an interval between the projecting portions formed on the two side faces of the annular groove of the regulating roller is made substantially equal to a width dimension of the unsealing tape.

11. The device for regulating a running position of unsealing tape for packing film according to claim 2, wherein the regulating roller is arranged upstream from the adhering device and an interval between the projecting portions formed on the two side faces of the annular groove of the regulating roller is made substantially equal to a width dimension of the unsealing tape.

12. The device for regulating a running position of unsealing tape for packing film according to claim 3, wherein the regulating roller is arranged upstream from the adhering device and an interval between the projecting portions formed on the two side faces of the annular groove of the regulating roller is made substantially equal to a width dimension of the unsealing tape.

13. The device for regulating a running position of unsealing tape for packing film according to claim 1, wherein a plurality of the regulating rollers are installed on the feed path, a distance between the projecting portions of a downstream most one of the plurality of regulating rollers being approximately equal to a width dimension of the unsealing tape, and a distance between the projecting portions of each of the remaining ones of the plurality of regulating rollers being larger than the adjacent downstream one of the plurality of regulating rollers.

14. The device for regulating a running position of unsealing tape for packing film according to claim 2, wherein a plurality of the regulating rollers are installed on the feed path, a distance between the projecting portions of a downstream most one of the plurality of regulating rollers being approximately equal to a width dimension of the unsealing tapes and a distance between the projecting portions of each of the remaining ones of the plurality of regulating rollers being larger than the adjacent downstream one of the plurality of regulating rollers.

15. The device for regulating a running position of unsealing tape for packing film according to claim 3, wherein a plurality of the regulating rollers are installed on the feed path, a distance between the projecting portions of a downstream most one of the plurality of regulating rollers being approximately equal to a width dimension of the unsealing tape, and a distance between the projecting portions of each of the remaining ones of the plurality of regulating rollers being larger than the adjacent downstream one of the plurality of regulating rollers.

16. The device for regulating a running position of unsealing tape for packing film according to claim 1, wherein a plurality of the regulating rollers are installed on the feed path and the distance between the projecting portions of all of the plurality of regulating rollers are substantially equal to a width dimension of the unsealing tape.

17. The device for regulating a running position of unsealing tape for packing film according to claim 2, wherein a plurality of the regulating rollers are installed on the feed path and the distance between the projecting portions of all of the plurality of regulating rollers are substantially equal to a width dimension of the unsealing tape.

18. The device for regulating a running position of unsealing tape for packing film according to claim 3, wherein a plurality of the regulating rollers are installed on the feed path and the distance between the projecting portions of all of the plurality of regulating rollers are substantially equal to a width dimension of the unsealing tape.

19. The device for regulating a running position of unsealing tape for packing film according to claim 1, wherein the running packing film is brought into press-contact with the outer peripheral face of the regulating roller and the regulating roller is rotated by friction caused in running the packing film.

20. The device for regulating a running position of unsealing tape for packing film according to claim 2, wherein the running packing film is brought into press-contact with the outer peripheral face of the regulating roller and the regulating roller is rotated by friction caused in running the packing film.

21. The device for regulating a running position of unsealing tape for packing film according to claim 3, wherein the running packing film is brought into press-contact with the outer peripheral face of the regulating roller and the regulating roller is rotated by friction caused in running the packing film.

22. The device for regulating a running position of unsealing tape for packing film according to claim 1, wherein a feed roller and a press-contact roller pinching the unsealing tape and transferring the unsealing tape and the packing film toward the adhering device are installed, the regulating roller is arranged on the feed path downstream from the feed roller and the press-contact roller and upstream from the adhering device and the packing film and the unsealing tape are wound in a U-like shape around the outer peripheral face of the regulating roller over a substantially half periphery of the outer peripheral face in the peripheral direction.

23. The device for regulating a running position of unsealing tape for packing film according to claim 2, wherein a feed roller and a press-contact roller pinching the unsealing tape and transferring the unsealing tape and the packing film toward the adhering device are installed, the regulating roller is arranged on the feed path downstream from the feed roller and the press-contact roller and upstream from the adhering device and the packing film and the unsealing tape are wound in a U-like shape around the outer peripheral face of the regulating roller over a substantially half periphery of the outer peripheral face in the peripheral direction.

24. The device for regulating a running position of unsealing tape for packing film according to claim 3, wherein a feed roller and a press-contact roller pinching the unsealing tape and transferring the unsealing tape and the packing film toward the adhering device are installed, the regulating roller is arranged on the feed path downstream from the feed roller and the press-contact roller and upstream from of the adhering device and the packing film and the unsealing tape are wound in a U-like shape around the outer peripheral face of the regulating roller over a substantially half periphery of the outer peripheral face in the peripheral direction.

25. The device of claim 1, wherein the projecting portion of one of the two side faces of the annular groove is circumferentially offset from the projecting portion of the other of the two side faces of the annular groove.

26. The device of claim 2, wherein the projecting portion of one of the two side faces of the annular groove is circumferentially offset from the projecting portion of the other of the two side faces of the annular groove.

27. The device of claim 3, wherein the projecting portion of one of the two side faces of the annular groove is circumferentially offset from the projecting portion of the other of the two side faces of the annular groove.

* * * * *

UNITED STATES PATENT AND TRADEMARK OFFICE

CERTIFICATE OF CORRECTION

PATENT NO. : 5,776,300

DATED : July 7, 1998

INVENTOR(S) : Taizo OGATA

It is certified that error appears in the above-identified patent and that said Letters Patent is hereby corrected as shown below:

At column 11, line 20 (claim 9, line 3)
delete "pluralities".

At column 11, line 61 (claim 14, line 7)
change "tapes" to ---tape,---.

Signed and Sealed this

Twenty-third Day of March, 1999

*Attest:*

Q. TODD DICKINSON

*Attesting Officer*

*Acting Commissioner of Patents and Trademarks*